US012385390B2

(12) United States Patent
Groves et al.

(10) Patent No.: US 12,385,390 B2
(45) Date of Patent: Aug. 12, 2025

(54) PERMANENT WELL MONITORING WITH ACOUSTICALLY TRANSPARENT PLUGS

(71) Applicant: Baker Hughes Oilfield Operations LLC, Houston, TX (US)

(72) Inventors: Duncan Groves, Houston, TX (US); John-Peter van Zelm, Calgary (CA); Andrew Hawthorn, Missouri City, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 96 days.

(21) Appl. No.: 18/175,290

(22) Filed: Feb. 27, 2023

(65) Prior Publication Data

US 2024/0287895 A1 Aug. 29, 2024

(51) Int. Cl.
*E21B 47/14* (2006.01)
*E21B 33/12* (2006.01)

(52) U.S. Cl.
CPC ..... *E21B 47/14* (2013.01); *E21B 33/1208* (2013.01)

(58) Field of Classification Search
CPC ..... E21B 47/14; E21B 33/1208
See application file for complete search history.

(56) References Cited

U.S. PATENT DOCUMENTS 6,588,267 B1 * 7/2003 Bradley ..... G01V 1/523 181/102
2013/0254222 A1 * 9/2013 Figueiredo (S.F.) Boneti ..... G06F 16/283 707/769
2016/0047236 A1 * 2/2016 Croux ..... E21B 47/16 367/82
2017/0292345 A1 * 10/2017 Jones ..... C09K 8/467
2019/0292905 A1 9/2019 Ross et al.
2020/0102820 A1 4/2020 Hudson et al.
2020/0393585 A1 * 12/2020 Jaaskelainen ..... E21B 47/135
2021/0047912 A1 2/2021 Hawthorn et al.
2021/0078749 A1 * 3/2021 Monti ..... B65C 9/045
2021/0079749 A1 * 3/2021 McGarian ..... E21B 33/12
2021/0131277 A1 * 5/2021 Giordano ..... E21B 47/16
2021/0355818 A1 * 11/2021 Holly ..... E21B 47/01
2022/0049601 A1 2/2022 Jaaskelainen et al.
2023/0287756 A1 * 9/2023 Carragher ..... E21B 36/008

OTHER PUBLICATIONS

International Search Report and Written Opinion issued by the Korean Intellectual Property Office as the International Searching Authority (KIPO/ISA) for PCT Application No. PCT/US2024/017228, mailed Jun. 28, 2024, 12 pages.

* cited by examiner

*Primary Examiner* — Amine Benlagsir
(74) *Attorney, Agent, or Firm* — Baker Hughes Company

(57) ABSTRACT

Systems and methods for communicating information acoustically through a plug in a temporarily or permanently abandoned well. The disclosed embodiments use an acoustically transmissive well plug, where an acoustic transmitter coupled to a measurement tool below the plug is coupled to the plug In a manner that is intended to maximize the coupling of the generated acoustic signals to the plug. These signals are then transmitted through the acoustically transmissive plug to an acoustic receiver that is coupled to the upper end of the plug. The acoustic receiver converts the acoustic signals to another form if necessary and forwards the signals to equipment at the surface of the well, or to intermediate transceivers that can relay the signals to the surface.

19 Claims, 4 Drawing Sheets

PERMANENT WELL MONITORING WITH ACOUSTICALLY TRANSPARENT PLUGS

BACKGROUND

Field of the Invention

The invention relates generally to the communication of data in well systems, and more particularly to systems and methods for communicating information acoustically through a plug in a temporarily or permanently abandoned well using an acoustically transmissive well plug.

Related Art

It is sometimes desirable to shut down and abandon wells. For instance, a well may be used to convey captured carbon to a subsurface reservoir, and after the carbon is stored in the reservoir, the well may need to be plugged to ensure that the carbon cannot leak from the reservoir, through the well and back to the surface. In another example, wells that are used to produce oil and gas may need to be abandoned when the well is no longer producing.

Typically, when a well is abandoned, the casing in the well is cut, and a cement plug is installed in the well. The cement plug can, in some instances, be several hundred feet long. Commonly, more than one cement plug is installed in a single well. The column of cement forming each plug is intended to be sufficient to ensure that none of the oil, gas, captured carbon, etc. can migrate up through the well to the surface.

In some instances, it may be enough to simply install the cement plugs in the well. In other words, once the well has been sealed, there is no need for an owner or operator of the well to monitor conditions in the well. In other instances, however, particularly when abandoning wells that are used in carbon sequestration, the well owner or operator may wish to know what the conditions are in the well below the cement plug. For example, they may wish to know what the temperature and pressure are within the well below the plug.

While it might seem that this problem could easily be solved by simply positioning one or more sensors below the plug to determine the desired conditions and running a wire from the sensors through the cement plug and to the surface of the well, this is not actually the case. This arrangement is not an adequate solution because the cement plug is not allowed to have any penetrations through it. Any penetration such as a wire or hole through the plug presents a potential leak path through the plug.

Conventionally, there is no good way to provide sufficient sealing at the penetration to ensure that there is no leakage through the cement plug, so wired sensors are not an acceptable solution. This is true for fiberoptic lines as well as electrical wires, as both require penetrations of the plug. Alternative means for communicating sensor telemetry such as electromagnetic radio waves are also inadequate. Because these systems would be positioned inside the steel casing of the well, the corresponding signals would be attenuated and could not travel far enough to effectively communicate telemetry across the plug.

Another possible means for communicating telemetry from a sensor beneath the well plug is an acoustic transmission system. An acoustic transmitter can generate sound waves embodying the sensor telemetry, and these sound waves can be communicated upward through the plug. While sound waves can travel reasonably well through many materials, however, this is not true of cement. Cement is actually a very good attenuator of acoustic signals. Consequently, it is very difficult to reliably transmit information through the several hundred feet of cement that form the well plug.

It would therefore be desirable to provide means for reliably communicating information from a sensor or other tool below a well plug to equipment at the surface of the well, or even above the plug within the well.

SUMMARY

Systems and methods disclosed herein provide means for communicating information acoustically through a plug in a temporarily or permanently abandoned well. The disclosed embodiments use an acoustically transmissive well plug, where an acoustic transmitter coupled to a sensor or other tool below the plug is coupled to the plug In a manner that is intended to maximize the coupling of the generated acoustic signals to the plug. These signals are then transmitted through the acoustically transmissive plug to an acoustic receiver that is coupled to the upper end of the plug. The acoustic receiver may forward the acoustic signals to equipment at the surface of the well, or to intermediate transceivers that can relay the signals to the surface. The acoustic receiver at the top of the well plug may also be configured to convert the acoustic signals to another form (e.g., electrical, electromagnetic, or optical signals) that can be conveyed or relayed to the surface.

In some embodiments, the acoustically transmissive well plug may comprise a bismuth plug that is formed on top of a packer that is installed in the well. The well plug may have rods made of metal or other acoustically transmissive materials, where a first portion of each rod is embedded in the well plug and another portion extends out of the plug for coupling to the respective acoustic transmitter or receiver. In an alternative embodiment, the well plug may be formed of a material other than bismuth. If the material is not itself very acoustically transmissive, the overall acoustic transmissiveness of the well plug may be enhanced by embedding a rod of metal or other acoustically transmissive material in the plug (without penetrating the plug) so that the acoustic signals are more effectively transmitted through the plug.

One embodiment comprises a system for communicating well conditions below a well plug. The system includes an acoustically transmissive well plug installed in a well, a sensor installed in the well below the well plug, an acoustic transmitter installed in the well below the well plug and an acoustic receiver installed in the well above the well plug. The sensor is configured to measure at least one parameter within the well below the well plug and to output measurement data corresponding to the at least one parameter. The acoustic transmitter is coupled to the sensor to receive the measurement data from the sensor, and is acoustically coupled to the well plug. The acoustic receiver is also acoustically coupled to the well plug. The acoustic transmitter is configured to generate acoustic signals embodying the measurement data from the sensor and to transmit the acoustic signals through the well plug to the acoustic receiver. The acoustic receiver is configured to then communicate the measurement data embodied in the acoustic signals to equipment uphole from the acoustic receiver.

In some embodiments, the well plug comprises a bismuth plug, while in other embodiments, the well plug comprises an epoxy resin or some other material that is acoustically transmissive. In some embodiments, the system includes a first metal rod which is embedded in a first end of the well plug that facilitates the acoustic coupling of either the acoustic transmitter or the acoustic receiver to the well plug through the first metal rod. The system may also include another metal rod which is embedded in the other end of the well plug to acoustically couple the other of the acoustic transmitter and acoustic receiver to the well plug.

In some embodiments, the acoustic transmitter and sensor are supported by a packer set in the well and the well plug is formed on top of the packer. The acoustic transmitter may be configured to transmit the acoustic signals over a spread frequency spectrum to the acoustic receiver. The acoustic receiver on top of the well plug may communicate to the to the uphole equipment via a wired communication channel, a wireless communication channel, an acoustic communication channel or any other type of communication channel.

An alternative embodiment comprises a system for acoustic communication through a well plug, where the system includes an acoustically transmissive well plug installed in a well, a measurement tool installed in the well below the well plug, a first acoustic transceiver installed in the well below the well plug and a second acoustic transceiver installed in the well above the well plug. The measurement tool is configured to measure at least one parameter within the well below the well plug and to output measurement data corresponding to the at least one parameter. The first acoustic transceiver is coupled to the measurement tool and is configured to communicate with the measurement tool. The first and second acoustic transceivers are acoustically coupled to the well plug. The first acoustic transceiver is configured to generate acoustic signals embodying the measurement data from the measurement tool and to transmit the acoustic signals through the well plug to the second acoustic transceiver. The first acoustic transceiver is also configured to receive acoustic signals embodying the control data from the second acoustic transceiver and to communicate the control data to the measurement tool. The second acoustic transceiver is configured to receive the acoustic signals embodying the measurement data from the first acoustic transceiver and to transmit the acoustic signals embodying the control data to the first acoustic transceiver. In some embodiments, the measurement tool is configured to modify a state of the measurement tool in response to receiving the control data.

Yet another alternative embodiment comprises a method for communicating through a well plug in a well. In this method, a first tool (e.g., a packer) is set in a well bore, where the tool supports a measurement tool and an acoustic transmitter. A well plug is then formed on the first tool using an acoustically transmissive material, where the acoustic transmitter is acoustically coupled to the well plug. An acoustic receiver is then positioned on top of the well plug, where the acoustic receiver is acoustically coupled to the well plug. At the measurement tool, one or more measurements are taken of one or more corresponding conditions within the well bore below the well plug and the measurements are provided to the acoustic transmitter. The acoustic transmitter then generates a set of acoustic signals encoding the measurements and applying the set of generated acoustic signals to the well plug. The acoustic receiver then receives the set of acoustic signals via the well plug and communicates the measurements encoded in the set of acoustic signals to equipment at the surface of the well.

In some embodiments, forming the well plug comprises melting bismuth in the well bore above the first tool and allowing the melted bismuth to harden in the well bore to form the well plug. In other embodiments, forming the well plug comprises filling a length of the well bore with epoxy resin and allowing the epoxy to harden in the well bore to form the well plug. Forming the well plug may include embedding one or more metal rods in the well plug and acoustically coupling at least one of the acoustic transmitter and the acoustic receiver to the one or more metal rods.

Numerous other embodiments may also be possible.

The various embodiments of the invention may provide a number of advantages over existing systems. In particular, the disclosed embodiments enable communication through plugs in abandoned wells so that well conditions below the plugs can be measured and information regarding these conditions can be provided to equipment or operators at the surface of the well. Still other benefits may be apparent to those skilled in the art. Other advantages may also be apparent to those of skill in the art.

BRIEF DESCRIPTION OF THE DRAWINGS

Other objects and advantages of the invention may become apparent upon reading the following detailed description and upon reference to the accompanying drawings.

Figure 1:
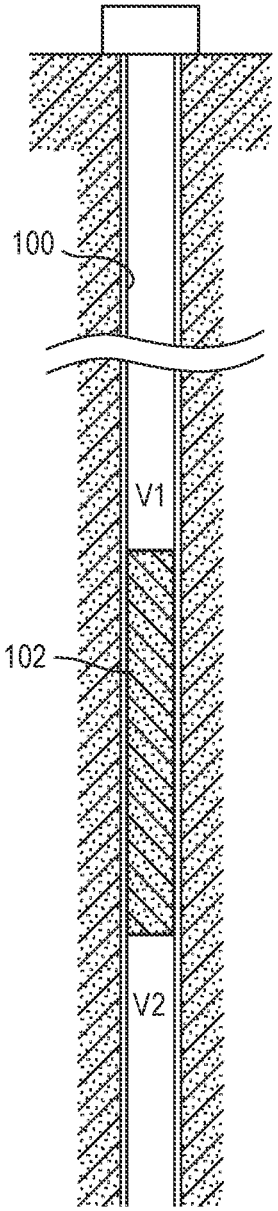
(prior art) FIG. 1
FIG. 1 is a diagram illustrating an abandoned well sealed by a cement plug in accordance with the prior art.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

When a well is abandoned, it is typically sealed by forming one or more cement plugs in the well bore. The plugs are designed to seal off the volume under the well from the volume above the plug.

Referring to FIG. 1, a diagram illustrating an abandoned well sealed by a cement plug in accordance with the prior art is shown. As depicted in this figure, a well bore 100 of a well is drilled through a geological formation and is cased. The well bore may extend downward to a reservoir (not shown in the figure). A plug 102 is formed in wellbore 100 to seal the volume below the plug (V2) from the volume (V1) above the plug.

When the well is plugged, whether permanently or temporarily, it is often necessary or desirable to be able to monitor parameters such as temperature and pressure below the plug(s). Knowledge of these parameters may be useful, for example, to ensure that there are no leaks through the plugs, or simply to have a better understanding of how a reservoir below the plug is behaving.

The plugs cannot have any penetrations though them because such penetrations would present potential leak paths through the plugs. Penetrations could therefore cause the plugs to fail to meet VO specifications or other requirements for permanent well abandonments. Consequently, although it would be a simple matter to position a sensor below the plug to monitor the desired well conditions (e.g., temperature, pressure), it is not possible to simply run a wire from the sensor, through the plug, to a receiver uphole from the plug.

Several methods for transmitting data through the permanent plug without any requiring penetration of the plug. For example, electromagnetic telemetry has been proposed, but it is unlikely that electromagnetic telemetry would suffer significant losses and it is unlikely that the signals would be able to propagate through the casing to a receiver above the plug. A method which appears to be more likely to be successful is to generate acoustic signals and to transmit the information generated by the sensor acoustically through the plug. Several acoustic transmission methods have been tried (e.g., using the casing as an acoustic guide) but the length of the cement plugs (potentially hundreds of feet) and the high attenuation associated with the cement makes these methods impractical as well.

The embodiments disclosed herein make use of an acoustically transmissive well plug to seal the well. In an exemplary embodiment, a tool incorporating a measuring device and an acoustic transmission system is attached to a mechanical packer that is set in the well. The packer supports the measuring and acoustic transmission tool and also provides a barrier on which a plug can subsequently be set. The plug that is installed on top of the packer is not a conventional cement plug, but is instead an acoustically transmissive plug which can be formed, for example, from a metal such as bismuth, or an epoxy-like material that does not attenuate acoustic signals the way cement plugs do.

In the case of a bismuth plug, the plug has significantly better acoustic transmission properties than conventional cement plugs. In addition to having better acoustic transmission properties than cement, a bismuth well plug can be shorter than a conventional cement plug. This is because bismuth expands as it hardens from a liquid state to a solid state. A bismuth plug is set by melting bismuth in the well bore and letting it solidify in the hole (e.g., on top of the packer), expanding in the well bore as it hardens and creating a very tight seal. This allows the plug to be shorter than a conventional cement plug. The bismuth plug may, for example, be several meters long, as compared to cement plugs which may need to be 100 meters long in order to meet isolation requirements. Consequently, the bismuth plug not only has better acoustic transmissivity than a cement plug, but also presents a shorter path over which the acoustic signals must be transmitted.

The acoustic system transmits data from the measurement tool using any of a variety of suitable modulation and encoding methods to achieve one or more objectives of improving reliability, extending range, reducing transmission power or extending battery life. These methods may include, for example, transmissions using spread spectrum modulation to provide significant signal processing gain upon reception, and the use of error correction encoding.

The top of the acoustically transmissive plug can be dressed if desired, or it can be left as-is after the plug is formed. Dressing the top of the plug may improve the coupling of the acoustic energy from the plug to an acoustic receiving tool at the top of the plug. The acoustic receiving tool may, in some embodiments, be a tool that is run down to the top of the plug and which picks up the acoustic signals transmitted through the plug and retransmits the signals acoustically to the surface of the well (possibly through other, relay devices). In other embodiments, the acoustic receiving tool may be a cable-deployed tool that converts the acoustic signals to electrical signals that are transmitted to the surface via the cable. Communications between the acoustic receiving tool and other uphole equipment (surface equipment, relays, etc.) may be one-way or two-way communications.

Figure 2:
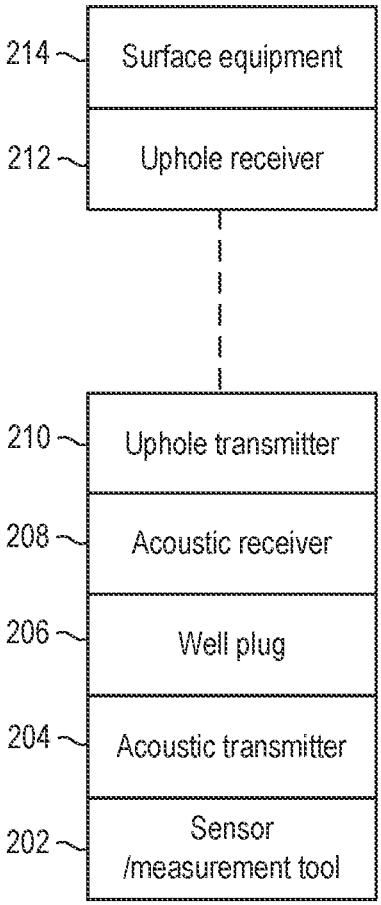
FIG. 2 is a block diagram illustrating the components of a system having a below-plug sensor and acoustic communication system in accordance with some embodiments.

Referring to FIG. 2, a block diagram illustrating the components of a system having a below-plug sensor and acoustic communication system in accordance with some embodiments is shown. As depicted in this figure, a well plug 206 is provided to seal a well that is temporarily or permanently abandoned. Well plug 206 is an acoustically transmissive plug, such as may be formed by melting bismuth in the well bore, where the bismuth hardens in the well bore to form the plug.

Below the plug, a sensor or other tool 202 that is adapted to measure one or more conditions of the well below plug 206 is provided. Measurement tool 202 is connected to an acoustic transmitter 204. Acoustic transmitter 204 is adapted to receive signals output by measurement tool 202 and to generate acoustic signals using the information received from measurement tool 202. The acoustic signals may use any suitable encoding of the data from the measurement tool. The acoustic signals may employ spread spectrum modulation techniques or other techniques such as error correction encoding to improve signal transmission across the well plug.

The acoustic signals generated by acoustic transmitter 204 are applied to the lower end of well plug 206, and the acoustic signals are transmitted through the plug. As described in more detail below, some embodiments may incorporate measurement tool 202 and acoustic transmitter 204 into a packer which is installed in the well bore so that the well plug can be set on top of it.

After plug 206 has been formed, an acoustic receiver 208 is installed on top of the plug. Acoustic receiver 208 is acoustically coupled to the plug so that acoustic signals transmitted through the plug from acoustic transmitter 204 are received by the acoustic receiver. The received acoustic signals are provided to an uphole transmitter 210 which is configured to transmit corresponding signals to an uphole receiver 212. Uphole transmitter 210 may forward the received acoustic signals, or it may convert the signals to another form (e.g., electrical signals) for transmission to equipment uphole in the well bore. Uphole receiver 212 converts the received signals if necessary and provides the signals to surface equipment 214. Surface equipment 214 may consume the signals, forward the signals to other equipment, display the corresponding information to a well operator, or otherwise process the signals.

Figure 3:
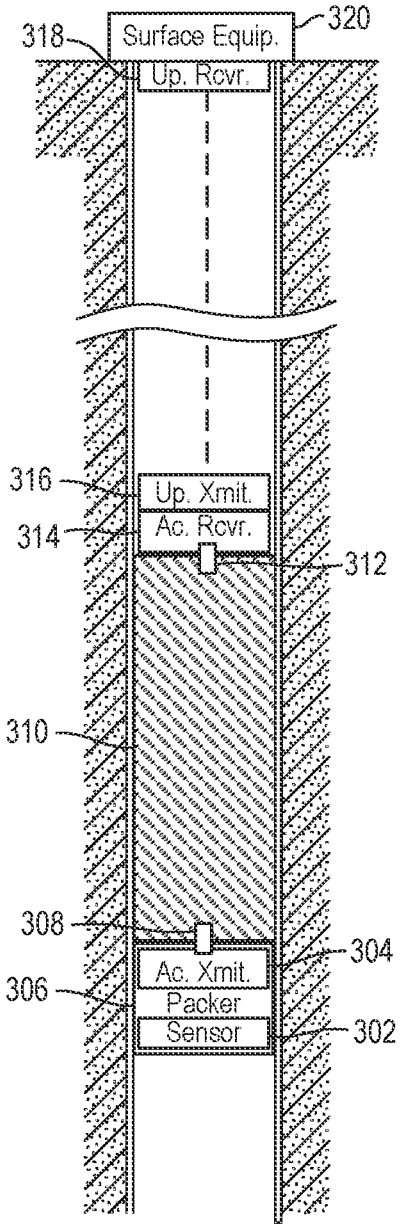
FIG. 3 is a diagram illustrating the installation of a sensing and acoustical transmission system in accordance with some embodiments.

Referring to FIG. 3, a diagram illustrating the installation of a sensing and acoustical transmission system in accordance with some embodiments is shown. In this embodiment, a sensor 302 and acoustic transmitter 304 are incorporated into packer 306. Packer 306 provides a means to support sensor 302 and acoustic transmitter 304 in the well bore, and also serves as a barrier on which the well plug 310 can be set.

After packer 306 is set in the well, plug 310 is formed. In the case of a bismuth plug, the plug can be installed by placing solid bismuth in the well above the packer and then melting the bismuth so that it fills a length of the well bore above the packer. Commonly, the bismuth is melted by placing thermite in the well bore and igniting the thermite to perform a controlled burn that generates sufficient heat to melt the bismuth which has a melting point of around 270 degrees Celsius.

In the embodiment of FIG. 3, a metal rod 308 is incorporated into packer 306. Metal rod 308 is coupled to acoustic transmitter 304 within the packer. Metal rod 308 extends upward, above the upper end of packer 306 so that, when well plug 310 is formed, the plug is formed around the upper end of the metal rod. Because the upper end of metal rod 308 is embedded in well plug 310, the acoustical coupling between the metal rod and the well plug is improved. Thus, acoustic signals generated by acoustic transmitter 304 are efficiently coupled through metal rod 308 and into well plug 310.

At the upper end of well plug 310, an acoustic receiver 314 is coupled to the plug. As depicted in this figure, a metal rod 312 is embedded in the top of well plug 310, similar to the way rod 308 is embedded in the lower end of the plug. This rod could, for example, be milled into the top of the plug so that acoustic receiver 314 can be acoustically coupled to the plug through the rod. The use of the top rod in this manner may improve acoustic transmission through the well plug to the acoustic receiver.

The acoustic signals received by acoustic receiver 314 via well plug 310 and metal rod 312 are provided to an uphole transmitter 316. Transmitter 316 forwards the information from acoustic receiver 314 uphole to receiver 318, which provides the received information to surface equipment 320. Transmitter 316 may be configured to transmit the information to receiver 318 in any suitable manner, including through acoustic, electrical, optical, or any other form of data signal. Transmitter 316 may transmit this information directly to receiver 318, or it may forward the information to one or more intermediate relays which successively forward the information uphole until it reaches receiver 318.

Figure 4:
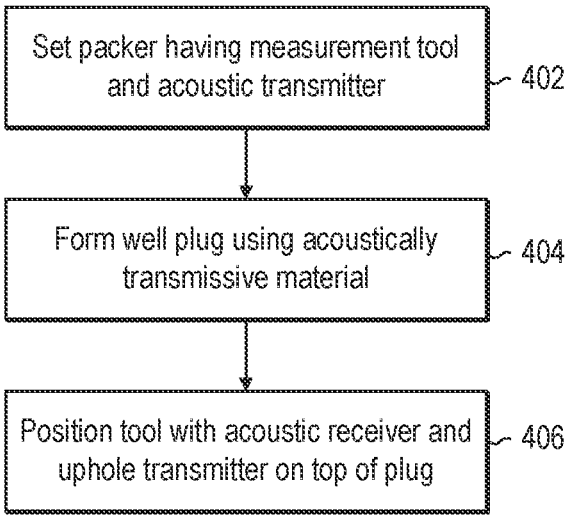
FIG. 4 is a flow diagram illustrating an exemplary method for installing a well plug system in accordance with some embodiments.

An exemplary method for installing a well plug system as disclosed herein is illustrated in FIG. 4. As depicted in this figure, a packer is initially set (402). As described above, the packer may have a sensor or measurement system incorporated therein for measuring well conditions below the plug when installed. The packer may also include an acoustic transmission system configured to receive data from the sensor or measurement system, generate acoustic signals therefrom, and communicate the acoustic signals to the well plug when set.

After the packer has been set, the well plug is installed (404). If a bismuth plug is to be installed, bismuth is placed in the well above the packer the bismuth is melted by means such as a controlled burn of thermite in the well. The melted bismuth hardens on top of the packer, expanding to fill the well bore and form a sealing plug in the well bore. The bismuth well plug may be formed around a metal rod extending upward from the acoustic transmitter so that the rod is embedded in the hardened well plug.

As noted above, the well plug may be formed using other types of acoustically transmissive materials as well. Another such acoustically transmissive material that could be used as a well plug is an epoxy-type material. An epoxy may be introduced into the well bore and allowed to harden on top of the packer to form the well plug. As with the bismuth plug, a plug formed using epoxy may be formed around a metal rod extending upward from the acoustic transmitter. When the epoxy hardens, the metal rod will be embedded in the epoxy, providing an efficient acoustic coupling between the acoustic transmitter and the epoxy well plug. Additionally, the embedded end of the rod could include geometric features, such as fins, wedges, etc., to further improve acoustic coupling between the plug and rod.

It should be noted that the types of acoustically transmissive well plugs described herein are intended to be illustrative rather than limiting. Various different types of acoustically transmissive material may be used to form the well plug in alternative embodiments, and installation of the plug will involve methods that are suitable for those particular materials. In addition to the bismuth and epoxy plugs noted above, alternative embodiments may use hybrid plugs that have metal rods or other acoustically transmissive elements embedded in them to increase the overall acoustic transmissibility of the plugs.

After the well plug is formed in the well bore, an acoustic receiver tool is installed at the top of the plug (406). In some embodiments, a metal rod is embedded in the top pf the plug when it is formed. The rod may be embedded in the same manner as the rod embedded in the lower end of the plug (e.g., the rod is positioned within the plug when it is formed in the well bore). The rod may be installed using any suitable alternative means as well.

When the acoustic receiver tool is installed, it is acoustically coupled to the well plug, such as by coupling the receiver to a metal rod embedded in the top of the plug. The acoustic receiver tool includes (or is coupled to) a transmitter that is adapted to transmit the acoustic signals received through the well plug. Alternatively, the transmitter may be adapted to convert the acoustic signals to a different form (e.g., electrical or optical signals) for transmission to other equipment uphole in the well.

Figure 5:
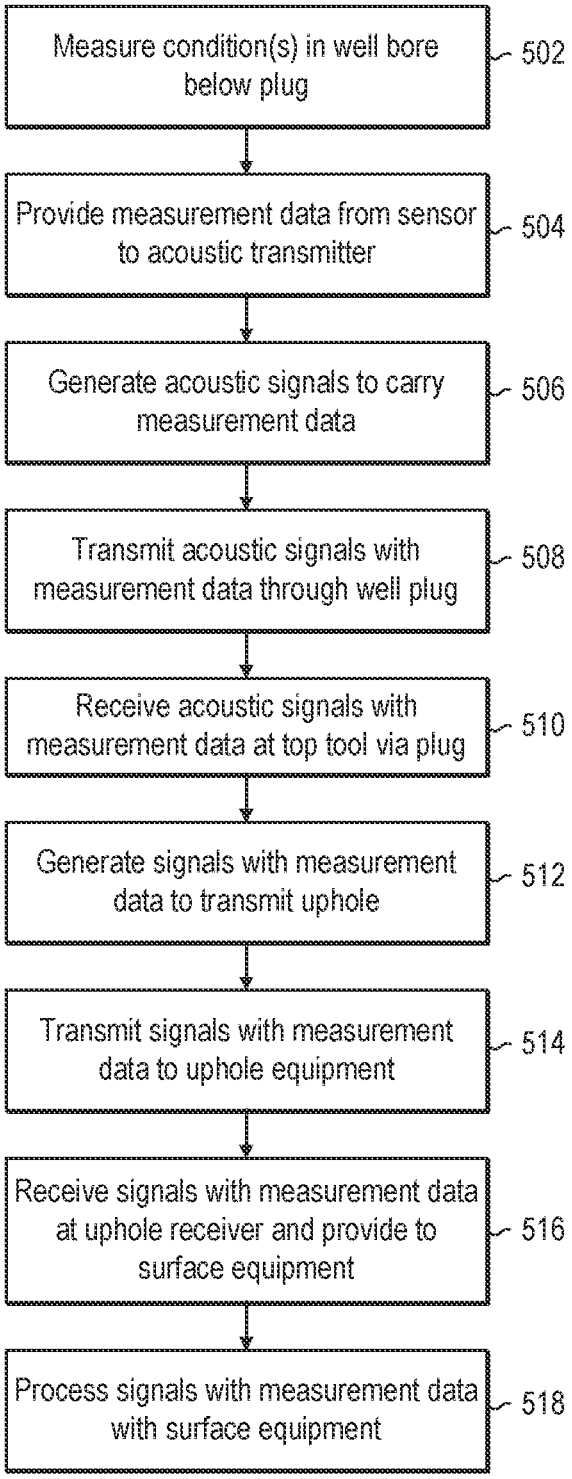
FIG. 5 is a flow diagram illustrating an exemplary method for measuring well conditions below a plug and communicating this information to surface equipment in accordance with some embodiments.

Referring to FIG. 5, a flow diagram illustrating an exemplary method for measuring well conditions below a plug and communicating this information to surface equipment is shown. Initially, the sensor or measurement tool below the well plug makes one or more measurements of corresponding conditions in the well bore below the plug (502). The measured conditions may include temperature, pressure, or any other conditional parameter that can be measured below the plug.

After making the measurements of the well conditions, the sensor or measurement tool provides output signals (e.g., electrical sensor output signals) to the acoustic transmitter (504). The acoustic transmitter then uses the signals received from the sensor or measurement tool to generate corresponding acoustic signals (506). The generated acoustic signals are then applied by the acoustic transmitter to the acoustically transmissive well plug (508) so that the signals will be transmitted through the plug, which may be made of bismuth, epoxy, or any other suitable acoustically transmissive material. As noted above, the acoustic signals may be applied to the well plug via a metal rod which is embedded in the plug and which extends downward, where it is coupled to the acoustic transmitter.

The acoustic signals which are transmitted through the well plug are received by the acoustic receiver which is coupled to the top of the plug (e.g., via a metal rod which is embedded in the top of the plug in and is coupled to the acoustic receiver) (510). The received acoustic signals are used to generate a corresponding set of signals that will be communicated uphole to equipment at the surface of the well (512). If the signals to be communicated are acoustic signals, it may not be necessary to convert the signals, but it may be necessary to amplify these signals before transmitting them. Alternatively, the acoustic signals may be converted to another form, such as electrical, optical or wireless electromagnetic signals, depending upon the type of communication channel over which the signals will be communicated.

After the signals are generated by the transmitter, the signals are transmitted uphole to another receiver (514). This receiver may be part of a relay that retransmits the signal further uphole, or it may be at the surface of the well. The information is received by a receiver at the surface of the well (516), It is provided to surface equipment so that it can be processed and/or used (e.g., displayed to a well operator) (518).

Figure 6:
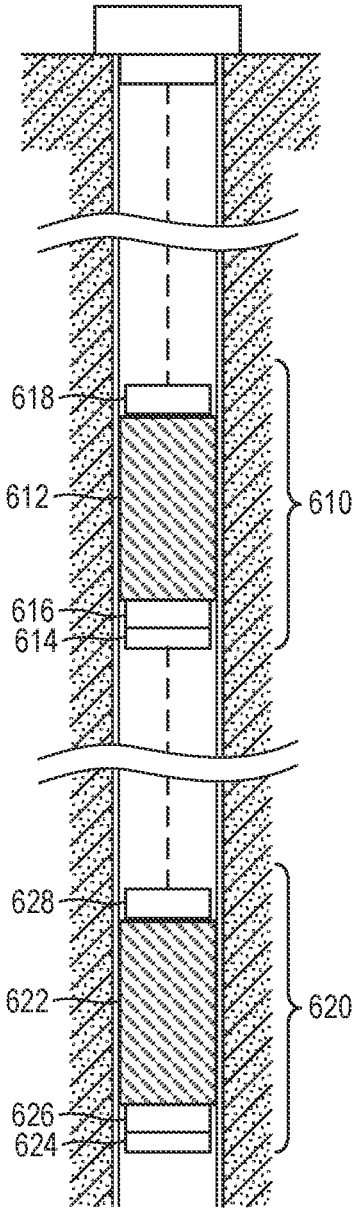
FIG. 6 is a diagram illustrating a well having multiple installed plugs with corresponding sensor and acoustic communication systems in a stacked configuration in accordance with some embodiments.

As noted above, an abandoned well may have more than one plug installed therein to prevent fluids from leaking out of the well. Referring to FIG. 6, a diagram is shown to illustrate a well having multiple installed plugs with corresponding sensor and acoustic communication systems in a stacked configuration.

As depicted in FIG. 6, there are two well plug systems (610, 620) which are installed in the well. Each of the well plug systems includes an acoustically transmissive plug (612, 622), a measurement tool (614, 624), an acoustic transmitter (616, 626) and an acoustic receiver (618, 628). Battery power is provided for the various components, which are isolated by the plugs.

In each of well plug systems 610 and 620, the corresponding measurement tool is adapted to measure one or more conditions or parameters within the well bore below the associated plug. The measurements output by the measurement tool are provided to the corresponding acoustic transmitter, which is adapted to generate acoustic signals to communicate the data output by the corresponding measurement tool. The acoustic transmitter is adapted to transmit the acoustic signals through the corresponding well plug to the corresponding acoustic receiver at the top of the plug. The acoustic receiver includes a transmitter to communicate the received data to equipment uphole from the transmitter. The transmitter could, for example, be connected by an acoustically conductive path such as wash pipe or sucker rods, to the bottom of well plug system, possibly with an acoustic repeater device.

In the case of the upper well plug system (610), the measurement tool and/or acoustic transmitter may be configured to receive signals communicated uphole from the lower well plug system (620). The upper well plug system can then function as a transceiver system for relaying information from the lower well plug system to the surface.

It should be noted that the receivers and transmitters described above may, in some embodiments, comprise transceivers in order to enable the systems to provide two-way communications. Thus, in addition to be capable of communicating information from the measurement tools below the well plugs to equipment above the well plugs, the equipment above the well plugs may be capable of communicating information (e.g., commands or other control information) to the measurement tools below the well plugs.

Figure 7:
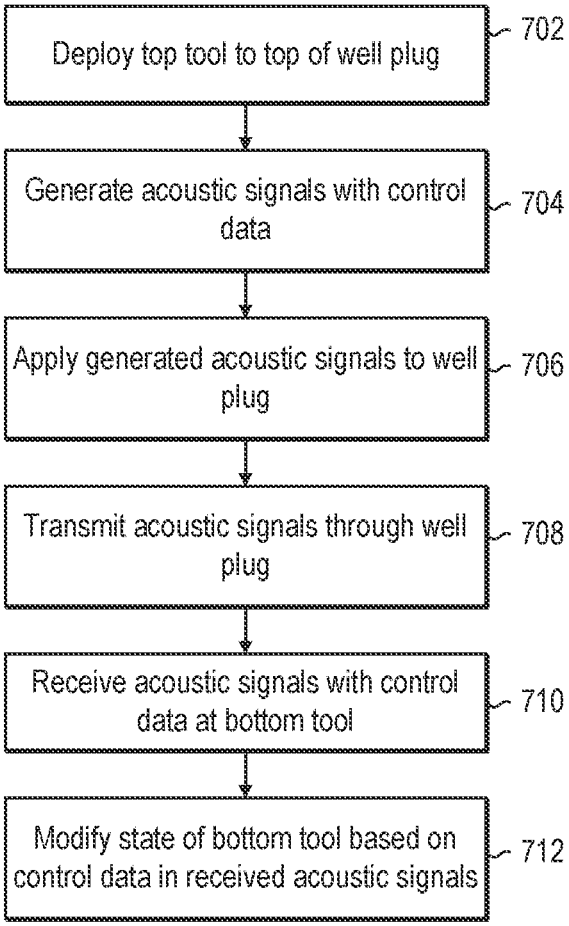
FIG. 7 is a flow diagram illustrating an exemplary method for activating a below-plug tool using two way communications in accordance with some embodiments.

Referring to FIG. 7, an exemplary method for activating a below-plug tool using two way communications is shown. In this example, a well plug system has been installed in an abandoned well. The well plug system has a measurement tool and acoustic signal transceiver positioned below the plug, where this first transceiver is configured to communicate with a second transceiver above the plug.

In the method of FIG. 7, a top tool that incorporates the second acoustic transceiver is deployed into the well and is positioned at the top of the plug (702). The tool can be landed on a rod at the top of the well plug, with acoustic coupling achieved through simple weight application. The tool generates an acoustic signal (704) and applies the acoustic signal to the upper end of the plug (706). The acoustic signal is transmitted through the plug (708) and is received by the acoustic transceiver positioned below the plug (710). The received acoustic signal is converted to a form (e.g., an electrical signal) suitable for the measurement tool and is provided to the measurement tool, which modifies its state based on the received signal (712).

For example, the measurement tool made change from a low-power standby state to an active state in which the tool provides previously collected measurements or makes new measurements of well conditions below the plug and provides these measurements to the below-plug transceiver to be acoustically transmitted through the plug back to the top tool. Similarly, after data has been collected from the measurement tool, the top tool can acoustically signal the measurement tool to return to a low-power state.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the described embodiments. As used herein, the terms "comprises", "comprising", or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the described embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed by the claims of the application.

What is claimed is:

1. A system for communicating well conditions below a well plug, the system comprising:

the well plug installed in a well, wherein the well plug is formed of an acoustically transmissive material, has no penetrations therethrough, and has one or more metal rods where a first portion of each metal rod is embedded in the well plug and another portion of said each metal rod extends out of the well plug for coupling to an acoustic transmitter or an acoustic receiver, the one or more metal rods increasing an acoustic transmissibility of the well plug;

a sensor installed in the well below the well plug, the sensor configured to measure at least one parameter within the well below the well plug and to output measurement data corresponding to the at least one parameter;

the acoustic transmitter installed in the well below the well plug, the acoustic transmitter coupled to the sensor and configured to receive the measurement data from the sensor, the acoustic transmitter acoustically coupled to the well plug; and the acoustic receiver installed in the well above the well plug, the acoustic receiver acoustically coupled to the well plug;

wherein the acoustic transmitter is configured to generate acoustic signals embodying the measurement data from the sensor and to transmit the acoustic signals through the well plug to the acoustic receiver; and wherein the acoustic receiver is configured to communicate the measurement data embodied in the acoustic signals to equipment uphole from the acoustic receiver.

2. The system of claim 1, wherein the well plug comprises a bismuth well plug.

3. The system of claim 1, wherein the well plug comprises an epoxy resin well plug.

4. The system of claim 1, further comprising a first metal rod which is embedded in a first end of the well plug, wherein at least one of the acoustic transmitter and the acoustic receiver is acoustically coupled to the well plug through the first metal rod.

5. The system of claim 4, further comprising a second metal rod which is embedded in a second end of the well plug, wherein the acoustic transmitter is acoustically coupled to the well plug through the first metal rod and the acoustic receiver is acoustically coupled to the well plug through the second metal rod.

6. The system of claim 1, wherein the acoustic transmitter and the sensor are supported by a packer in the well, and wherein the well plug is formed on top of the packer.

7. The system of claim 1, further comprising a wired communication channel coupling the acoustic receiver to the equipment uphole from the acoustic receiver.

8. The system of claim 1, further comprising a wireless communication channel coupling the acoustic receiver to the equipment uphole from the acoustic receiver.

9. The system of claim 1, further comprising an acoustic communication channel coupling the acoustic receiver to the equipment uphole from the acoustic receiver, the acoustic communication channel including a second acoustic transmitter which acoustically transmits the measurement data through a second well plug to a second acoustic receiver.

10. The system of claim 1, wherein the acoustic transmitter is configured to transmit the acoustic signals using at least one of: spread frequency spectrum modulation techniques; and error encoding techniques.

11. A system for acoustic communication through a well plug, the system comprising:

the well plug installed in a well, wherein the well plug is formed of an acoustically transmissive material, has no penetrations therethrough, and has one or more metal rods where a first portion of each metal rod is embedded in the well plug and another portion of said each metal rod extends out of the well plug for coupling to a first acoustic transceiver, the one or more metal rods increasing an acoustic transmissibility of the well plug;

a measurement tool installed in the well below the well plug, the measurement tool configured to measure at least one parameter within the well below the well plug and to output control data corresponding to the at least one parameter;

the first acoustic transceiver installed in the well below the well plug, the first acoustic transceiver coupled to the measurement tool and configured to communicate with the measurement tool, the first acoustic transceiver acoustically coupled to the well plug; and a second acoustic transceiver installed in the well above the well plug, the second acoustic transceiver acoustically coupled to the well plug;

wherein the first acoustic transceiver is configured to generate acoustic signals embodying the control data from the measurement tool and to transmit the acoustic signals through the well plug to the second acoustic transceiver; and wherein the first acoustic transceiver is configured to receive the acoustic signals embodying the control data from the second acoustic transceiver and to communicate the control data to the measurement tool.

12. The system of claim 11, wherein the measurement tool is configured to receive the control data from the first acoustic transceiver and, in response to the control data that was received, modify a state of the measurement tool.

13. A method for communicating through a well plug in a well, the method comprising:

setting a first tool in a wellbore, the first tool supporting a measurement tool and an acoustic transmitter;

forming the well plug on the first tool using an acoustically transmissive material, has no penetrations therethrough, wherein the acoustic transmitter is acoustically coupled to the well plug;

positioning an acoustic receiver on top of the well plug, wherein the acoustic receiver is acoustically coupled to the well plug and wherein the well plug has one or more metal rods where a first portion of each metal rod is embedded in the well plug and another portion of said each metal rod extends out of the well plug for coupling to the acoustic transmitter or the acoustic receiver, the one or more metal rods increasing an acoustic transmissibility of the well plug;

taking, at the measurement tool, one or more measurements of one or more corresponding conditions within the wellbore below the well plug and providing the one or more measurements to the acoustic transmitter;

generating, by the acoustic transmitter, a set of acoustic signals encoding the one or more measurements and applying the set of acoustic signals to the well plug; and receiving, by the acoustic receiver, the set of acoustic signals via the well plug and communicating the one or more measurements encoded in the set of acoustic signals to equipment at a surface of the well.

14. The method of claim 13, wherein forming the well plug further comprises melting bismuth in the wellbore above the first tool and allowing the melting bismuth to harden in the wellbore to form the well plug.

15. The method of claim 13, wherein said forming the well plug further comprises filling a length of the wellbore with epoxy resin and allowing the epoxy resin to harden in the wellbore to form the well plug.

16. The method of claim 13, wherein said forming the well plug further comprises embedding the one or more metal rods in the well plug and acoustically coupling at least one of the acoustic transmitter and the acoustic receiver to the one or more metal rods.

17. The method of claim 13, wherein the first tool comprises a packer.

18. The method of claim 13, wherein said forming the well plug further comprises introducing the acoustically transmissive material into the well and allowing the acoustically transmissive material to harden to form the well plug.

19. The method of claim 13, wherein the one or more metal rods has an embedded end which is embedded in the acoustically transmissive material, wherein the embedded end has one or more geometric features to improve acoustic coupling between the well plug and the one or more metal rods.

* * * * *